US011780482B2

(12) United States Patent
Mijatovic et al.

(10) Patent No.: US 11,780,482 B2
(45) **Date of Patent: *Oct. 10, 2023**

(54) METHOD, CONTROLLER AND TRACK CIRCUIT FOR DETERMINING THE RELATIONSHIP BETWEEN A TRACK-CIRCUIT TRANSMITTED CURRENT SIGNAL AND A RAILWAY VEHICLE LOCATION ON A RAILWAY TRACK

(71) Applicant: ALSTOM Transport Technologies, Saint-Ouen-sur-Seine (FR)

(72) Inventors: Nenad Mijatovic, Melbourne, FL (US); Jeffrey Fries, Grain Valley, MO (US); Jesse Herlocker, Grain Valley, MO (US); Saleheh Seif, Naples, FL (US); Keval Doshi, Tampa, FL (US)

(73) Assignee: ALSTOM Transport Technologies, Saint-Ouen-sur-Seine (FR)

( * ) Notice: Subject to any disclaimer, the term of this patent is extended or adjusted under 35 U.S.C. 154(b) by 348 days.

This patent is subject to a terminal disclaimer.

(21) Appl. No.: 17/175,996

(22) Filed: Feb. 15, 2021

(65) Prior Publication Data

US 2022/0258781 A1 Aug. 18, 2022

(51) Int. Cl.
*B61L 25/02* (2006.01)
*B61L 1/18* (2006.01)

(52) U.S. Cl.
CPC ..... *B61L 25/02* (2013.01); *B61L 1/182* (2013.01); *B61L 1/185* (2013.01); *B61L 25/025* (2013.01)

(58) Field of Classification Search
CPC ..... B61L 25/00; B61L 25/02; B61L 25/025; B61L 25/026; B61L 25/028; B61L 25/04; B61L 25/06; B61L 25/065; B61L 1/182; B61L 1/185
See application file for complete search history.

(56) References Cited

U.S. PATENT DOCUMENTS

| | | | | |
|---|---|---|---|---|
| 5,330,134 | A * | 7/1994 | Ehrlich | B61L 3/24 246/34 B |
| 9,026,283 | B2 * | 5/2015 | Baldwin | B61L 29/282 701/19 |
| 9,481,384 | B2 * | 11/2016 | Noffsinger | B61L 3/10 |
| 9,481,385 | B2 * | 11/2016 | Fries | B61L 29/30 |
| 9,663,126 | B2 * | 5/2017 | Orion | B61L 3/12 |
| 9,834,237 | B2 * | 12/2017 | Plotnikov | B61L 23/044 |
| 10,730,536 | B2 * | 8/2020 | Ahuja | B61L 3/006 |
| 11,577,763 | B2 * | 2/2023 | Mijatovic | B61L 3/24 246/34 B |

(Continued)

*Primary Examiner* — Zachary L Kuhfuss
*Assistant Examiner* — Cheng Lin
(74) *Attorney, Agent, or Firm* — Soquel Group LLC

(57) ABSTRACT

Method for determining the relationship between a track-circuit current signal and a railway vehicle location, including sending, by a track circuit, a current signal across a railway track block, measuring the current signal for different railway vehicles running successively on the railway track block, thus obtaining a plurality of railway vehicle move samples, normalizing the railway vehicle move samples, initializing a reference curve, and applying a Weighted Dynamic Time Warping Barycenter Averaging algorithm to calculate a final reference curve representing the relationship between the measured track-circuit current signal and the railway vehicle location on the railway track block.

9 Claims, 21 Drawing Sheets

(56) References Cited

U.S. PATENT DOCUMENTS

| | | | | |
|---|---|---|---|---|
| 2008/0296441 | A1* | 12/2008 | Anderson | B61L 23/044 246/121 |
| 2018/0178821 | A1* | 6/2018 | Fries | H04B 3/48 |
| 2020/0011015 | A1* | 1/2020 | Mijatovic | B61L 27/53 |
| 2021/0122402 | A1* | 4/2021 | Böhm | B61L 23/045 |

* cited by examiner

Algorithm 4: Weighted DBA with Averating for TC Reference Sequence Calculation input : A list with normalized train move data sequences, $I_1^n, I_2^n, \ldots, I_T^n$ and number of algorithm iteration N.

output : Normalized TC reference sequence, $R^n = \langle r_1^n, r_2^n, \ldots, r_P^n \rangle$

```
begin
    Initialize the TC reference sequence R^n;
    repeat
        for i=1 to T do
            Calculate DTW(I_i^n, R^n) between the ith train move and reference sequence;
            Find all elements of ith train move sequence elements that are associated with appropriate elements
            of the reference sequence using DTW;
        end
        Update the elements of the reference sequence {r_p^n}_{p=1}^P as the weighted average value of all
        associated elements of all train moves;
    until Number of iterations N reached OR no new DTW updates
end
```

FIG.2

METHOD, CONTROLLER AND TRACK CIRCUIT FOR DETERMINING THE RELATIONSHIP BETWEEN A TRACK-CIRCUIT TRANSMITTED CURRENT SIGNAL AND A RAILWAY VEHICLE LOCATION ON A RAILWAY TRACK

FIELD OF THE INVENTION

The present invention relates to a method for determining the relationship between a track-circuit transmitted current signal and a railway vehicle location on a railway track. Further, the present invention relates to a controller and to a track circuit for determining the relationship between a track-circuit transmitted current signal and a railway vehicle location on a railway track.

BACKGROUND OF THE INVENTION

Track circuits are used to locate the position of a railway vehicle within a railway track, for enabling virtual signaling within advanced railway vehicle control systems.

In fact, railroads that have implemented Positive Train Control systems (e.g. ITCS, ETCS, I-ETMS, etc.) as overlays to existing signal systems, ultimately desire to move towards a virtual signal system where no physical signals exist. Virtual signal systems can allow railroads to realize more capacity without having to physically install more signals and shorten existing signal blocks. Virtual signal systems also eliminate the maintenance associated with physical signals (e.g., replacing lamps, aligning signals, cleaning lenses, etc.). In order to realize virtual signaling, the location of a railway vehicle in a railway track must be known.

In order to increase the exploitation capacity of a railway system, it is necessary to space railway vehicles more closely together, therefore, track-circuits may be used to localize railway vehicles to a smaller resolution between existing signals.

The track circuits use a measured amount of current transmitted into front axles of an approaching railway vehicle, or rear axles of a receding railway vehicle, to determine where the nearest axle is located along a railway track block.

However, the relationship between the track-circuit transmitted current signal and the actual location of the railway vehicle in the track block cannot be analytically analyzed (e.g., using linear models) because it is non-linear. This relationship may in fact be different between different geographical locations, or due to different factors such as track circuit length, rail resistance, ballast resistance, railway vehicle axle resistance, weather conditions, etc.

As above indicated, track circuits use a track-circuit transmitted current signal to estimate the location of a railway vehicle within a railway track block.

U.S. patent application Ser. No. 16/811,244 discloses how to use a Dynamic Time Warping algorithm to estimate a railway vehicle position with reference to a track-circuit current signal.

However, the method disclosed in U.S. patent application Ser. No. 16/811,244 has several drawbacks:

- the reference curve initialization operation, based on a railway vehicle move data set is a time-consuming process; and
- the method shows some sensitivity to irregular railway vehicle movements, such as speed profiles with biased acceleration/deceleration values at a same location on the railway track (such as those associated with temporary speed restrictions or changes in track curvature/grade).

There is therefore a need to develop an innovative method, controller and track circuit for determining the relationship between a track-circuit transmitted current signal and a railway vehicle location, which overcomes the above-mentioned drawbacks.

SUMMARY OF THE DESCRIPTION

These and other objects are fully achieved by virtue of a method for determining the relationship between a track-circuit transmitted current signal and a railway vehicle location having the characteristics defined in independent claim 1, by a controller for determining the relationship between a track-circuit transmitted current signal and a railway vehicle location having the characteristics defined in independent claim 7, and by a track circuit as defined in claim 8.

Preferred embodiments of the invention are specified in the dependent claims, whose subject-matter is to be understood as forming an integral part of the present description.

BRIEF DESCRIPTION OF THE DRAWINGS

Further characteristics and advantages of the present invention will become apparent from the following description, provided merely by way of a non-limiting example, with reference to the enclosed drawings, in which:

FIG. 2 is a list of the operations of the Weighted Dynamic Time Warping Barycenter Averaging (WDBA) algorithm;

DETAILED DESCRIPTION

The method of the present invention allows performing a dynamic determination of the relationship between the transmitted current signal and the railway vehicle location, it is completely autonomous and adaptable to changing conditions.

The method of the present invention allows estimating the relationship between a track-circuit transmitted current signal and a railway vehicle location in an automatic manner.

The method of the present invention is based on the use of a Dynamic Time Warping (DTW) method. The DTW method, which is known per se, allows non-linear mapping of one signal to another by minimizing the distance between the two signals. The method finds an optimal alignment between two signals, also called sequences, and captures similarities by aligning the coordinates inside both sequences.

With regard to virtual block track circuits, in U.S. patent application Ser. No. 16/811,244, the DTW method is used to first align transmitted track-circuit current signals (versus time) coming from a plurality of railway vehicles running on a railway track block (railway vehicle moves), and then to calculate a reference curve as the average value of all the aligned curves (versus location). The reference curve represents the relationship between the track-circuit transmitted current signals and the railway vehicle locations on the railway track block for which it has been calculated.

Figure 1:
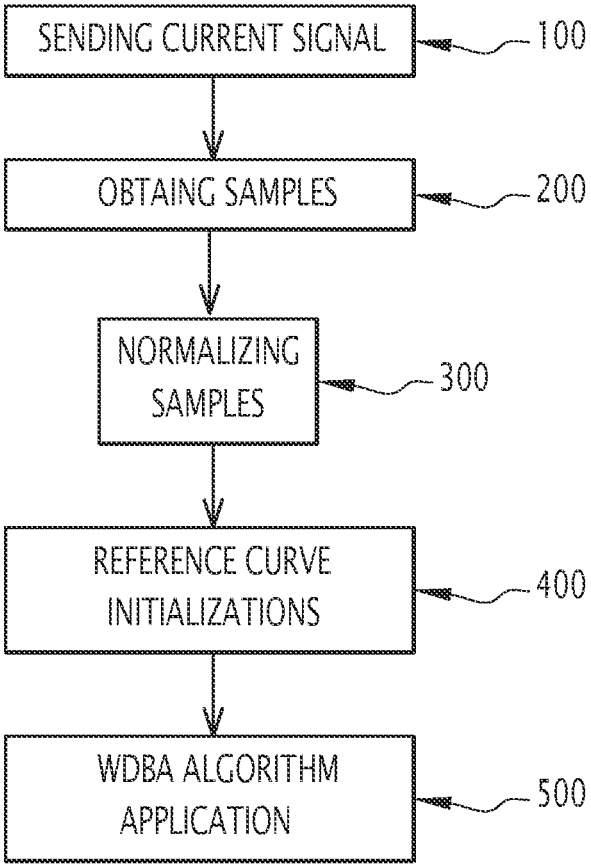
FIG. 1 is a block diagram of a method in accordance with an embodiment of the present invention.

FIG. 1 is a block diagram of a method in accordance with an embodiment of the present invention.

Firstly, at operation 100, a current signal is sent, by a track circuit, across a railway track block, and then, at operation 200, the current signal is measured for different railway vehicles running successively on the railway track block, thus obtaining a plurality of railway vehicle move samples.

Then, at operation 300, the railway vehicle move samples are linearly transformed (normalized) from their original domain into a [0,1] domain.

In many Machine Learning (ML) applications, including different classification approaches utilizing DTW methods, it is a common practice to scale data set values to a closed interval, such as [0,1] or [−1,1]. This process is called normalization. Z-normalization presents one of the dominant scaling approaches for the method of the present invention. Usually, a normalization is performed individually for each time series sequence from a data set (e.g., each time sequence represents one railway vehicle move sequence).

However, this is not suitable for determining the reference curve, since it would not be possible to perform an inverse transformation from the normalized average curve to the true or original range. Furthermore, this approach is invariant to any voltage gain changes on the transmitter side.

Thus, according to the present invention, a global normalization approach is performed, using maximum and minimum values of the plurality of railway vehicle move samples.

Formally, global minimum and maximum values of the railway vehicle moves are the followings:

$$I_{min}=\min\{\min(I_1),\min(I_2), \ldots ,\min(I_T)\} \text{ and}$$

$$I_{max}=\max\{\max(I_1),\max(I_2), \ldots ,\max(I_T)\}$$

respectively, where min and max represent minimum and maximum operations, and $I_T$ is the railway vehicle move sample that contains Pt transmitted current values, $I_{t1}$, $I_{t2}$, . . . , $I_{tPt}$ up to T total railway vehicle move samples (t=1, . . . , T).

Finally, the following global min-maximum normalization is calculated:

$$I_{tp}^{n} = \frac{I_{tp} - I_{min}}{I_{max} - I_{min}},$$

where $I^{n}_{tp}$ represents a normalized value of the p-th sample $I_{tp}$ of t-th railway vehicle move $I_t$.

By using the above normalization, all railway vehicle move samples are linearly transformed from their original domain into a [0,1] domain.

This approach allows readily performing the inverse linear transformation from the normalized domain into the original domain, according to the following equation:

$$I_{tp}=I_{min}+I_{tp}^{n}(I_{max}-I_{min}).$$

Returning to FIG. 1, at operation 400, a reference curve initialization is performed.

In particular, the reference curve is initialized either as a sequence of random numbers between 0 and 1 or as a deterministic curve with values, again, between 0 and 1.

For example, the reference curve may be initialized using data sampled from the uniform distribution defined between 0 and 1. The number of points of the initialized reference curve is determined based on the length of the railway vehicle moves sequence.

Finally, at operation 500, a novel method, designated Weighted DTW Barycenter Averaging (WDBA) algorithm, is presented to calculate a final reference curve.

FIG. 2 is a list of the operations of the WDBA algorithm, which will be disclosed here below with reference to the numbered operations of FIG. 2. The term "railway vehicle" in FIG. 2, and in the following description of the WDBA algorithm for coherence, is replaced by "train".

In an initial operation 2, which corresponds to operations 400 and 500 above detailed, a reference curve is initialized using values in the 0 to 1 range, with a predefined number of samples. At operations 4 and 5, for each normalized train move $I^{n}_{t}$, a DTW score is calculated, in a manner per se known, with the initialized reference curve, to determined corresponding intermediate points. Finally, at operation 8, based on the intermediate points, a weighted average is performed, in order to update all samples of the initialized reference curve, thus obtaining the final reference curve. The algorithm repeats operations 3-8 until the maximum number of iterations is reached or there are no more DTW updates found in operations 4-7.

The final reference curve represents the relationship between the track-circuit transmitted current signals and the railway vehicle locations on a railway track block for which it has been calculated.

The weights may be obtained from different kernels.

Figure 3:
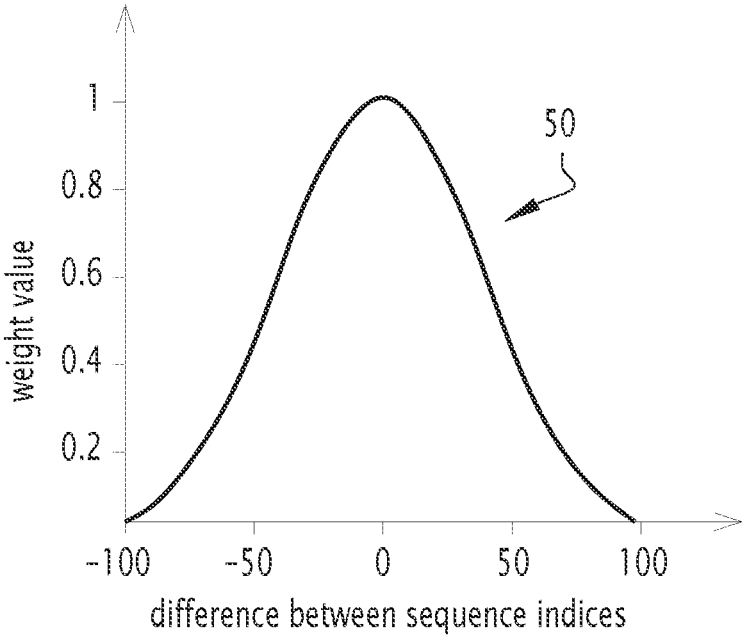
FIG. 3 is an exemplary Gaussian kernel curve.

FIG. 3 is an exemplary of a Gaussian kernel curve 50 used to calculate weights based on the difference between sequence indices between the current reference curve (based on algorithm iteration in FIG. 2) and the railway vehicle move samples. For a given difference between an initialized reference curve value and a corresponding railway vehicle move sample, an appropriate weight value is selected, within a 0 and 1 range. For the smaller spacing between indices of two sequences, which corresponds to a smaller time difference between samples, a larger weight value is selected, stipulating the larger overall impact of the railway vehicle move sample to the overall initialized reference curve value. The opposite applies as well: larger distances between the initialized reference curve values and the railway vehicle move samples are weighted less. Using the above disclosed approach, valid railway vehicle moves are rewarded, and possible outliers occurring during the update operation are disregarded.

The updating of the initialized reference curve is stopped, in FIG. 2 at operation 9, when either the maximum number of iterations is reached or there are no new updates to the initialized reference curve.

The following figures show examples of improvements when using the method according to the present invention, vis-à-vis the method of U.S. patent application Ser. No. 16/811,244 (the "conventional method").

Two different data sets have been used to demonstrate improved results over the conventional method: simulated railway vehicle moves to test specific speed profiles, and real railway vehicle moves collected from test trials.

Figure 4:
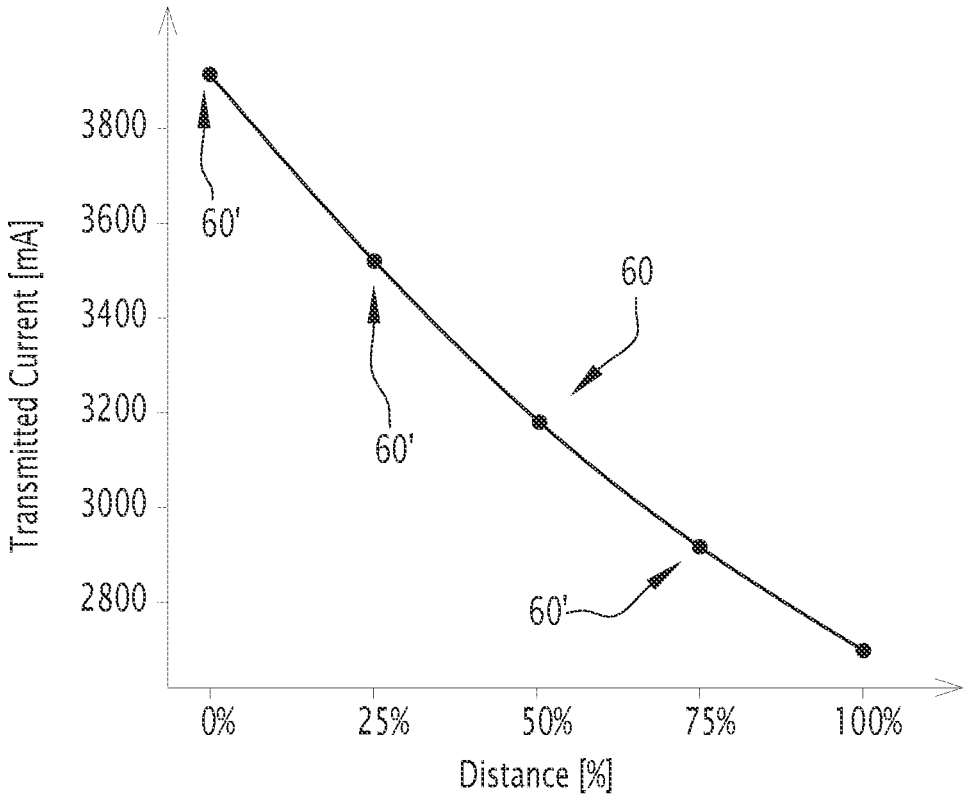
FIG. 4 is an exemplary true reference curve, as a function of transmitted current vs. distance.

Firstly, the accuracy of the proposed method was assessed using simulated railway vehicle moves, for which a true reference curve 60 is known, as illustrated in FIG. 4. FIG. 4 is an exemplary true reference curve 60, as a function of transmitted current [mA].

For the simulations, it was assumed that the true reference curve is available. The true reference curve 60 represents therefore an assumed known relationship between the distance and the transmitted current used for simulations. It may be generated using available measurements performed in a controlled environment during testing: manual shunts are placed on 0%, 25%, 50%, 75% and 100% of distances along a track, and respective transmitted current values are collected.

FIG. 4 shows such five points 60'.

Figure 5:
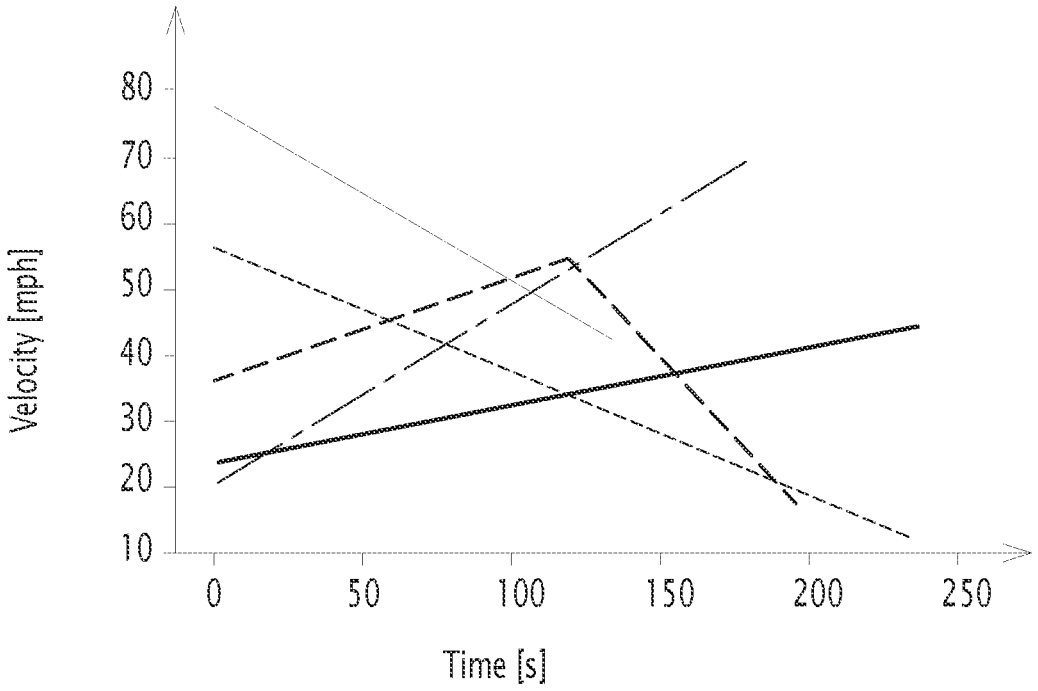
FIG. 5 is an illustration of different railway vehicle profiles with random speeds at different locations.
Figure 6:
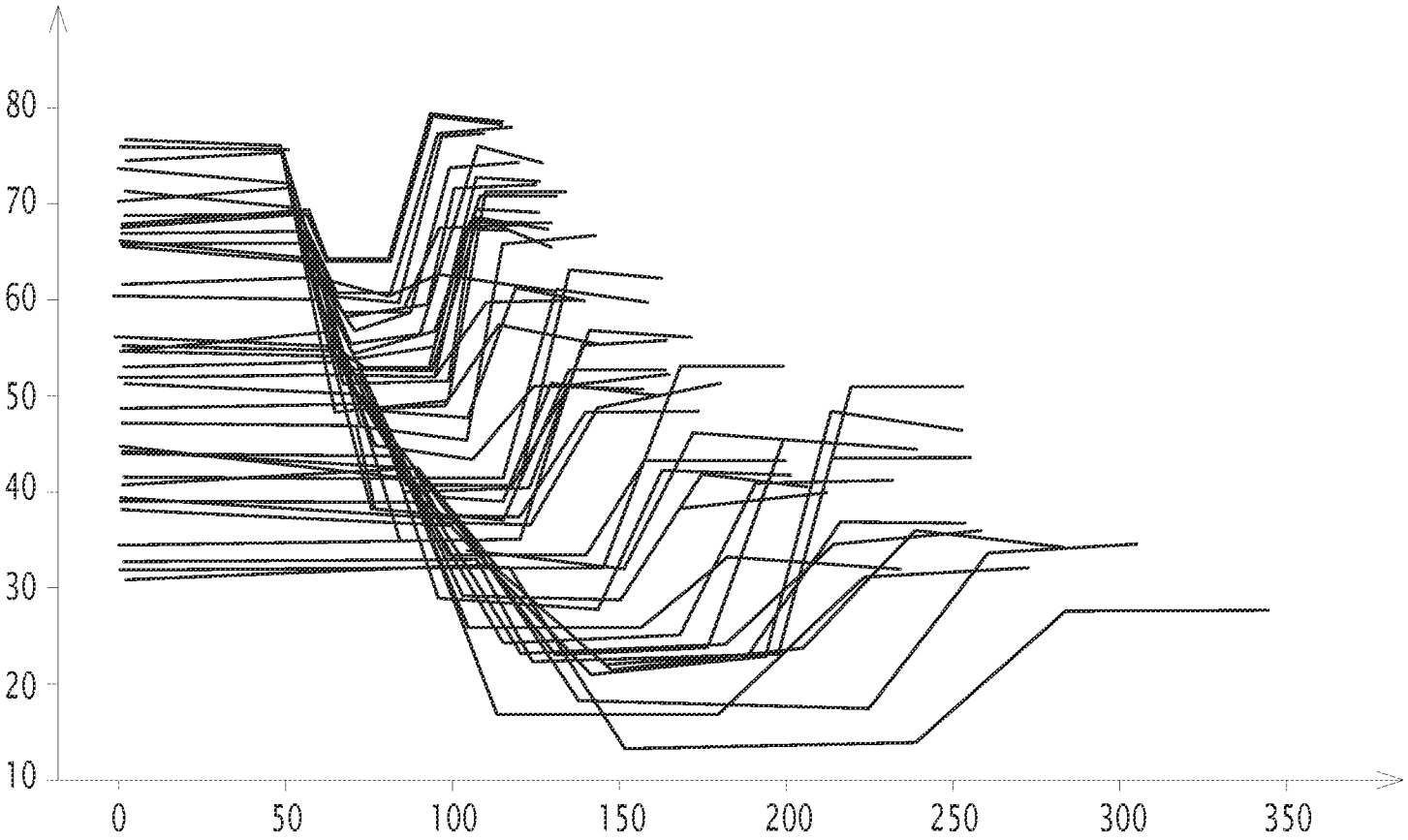
FIG. 6 is an illustration of different railway vehicle profiles with simultaneous deceleration and acceleration speed values at the same locations.
Figure 7:
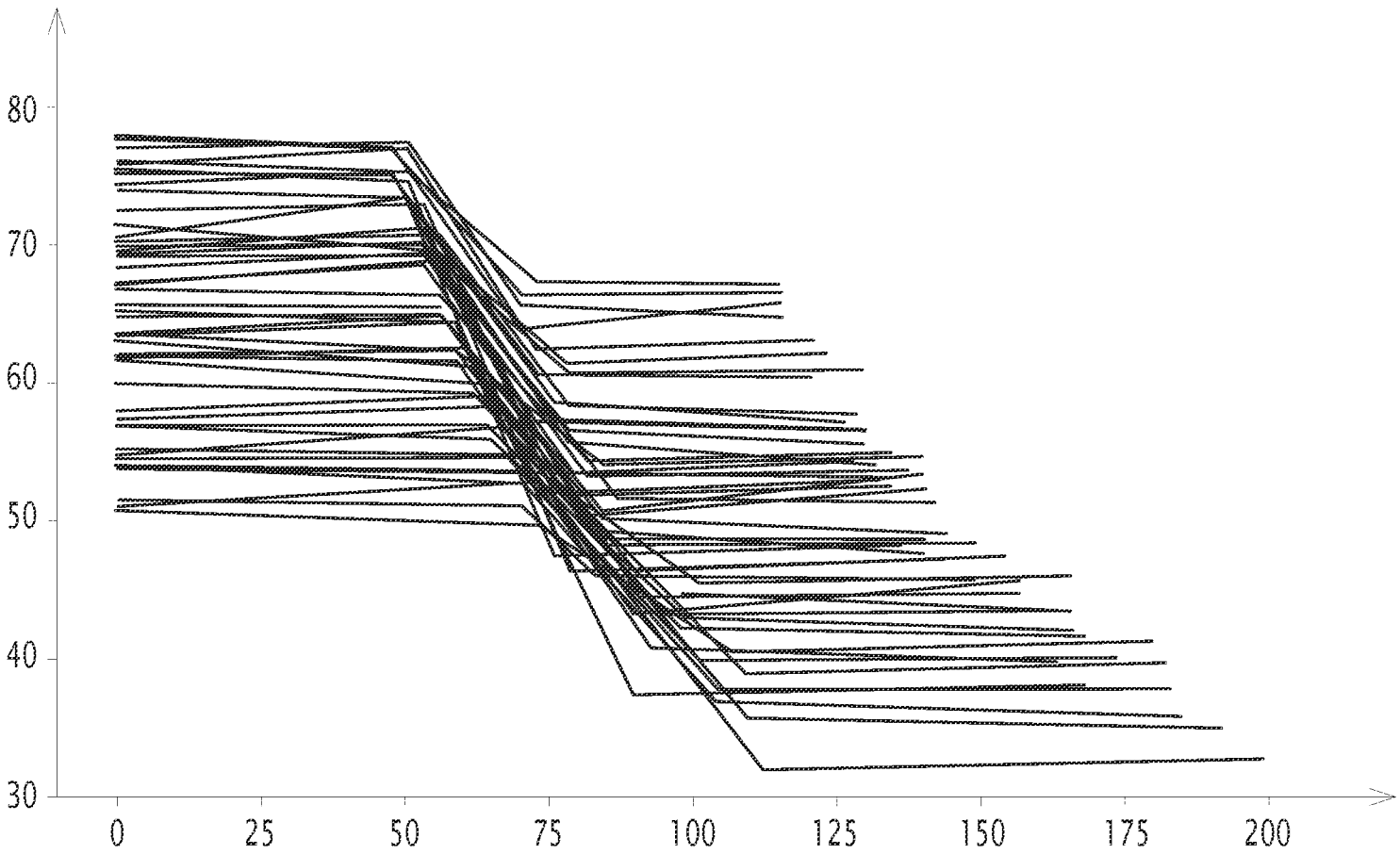
FIG. 7 is an illustration of different railway vehicle profiles with only deceleration.

It was assumed that all railway vehicle moves may be generated using the true reference curve 60 by applying different speed profiles, as illustrated in FIGS. 5, 6 and 7, which are illustrations of the most common train speed profiles. In particular, FIG. 5 shows different railway vehicle profiles with random speeds at different locations (correspond to different time instances), FIG. 6 shows different railway vehicle profiles with simultaneous deceleration and acceleration speed values at the same locations (correspond to different time instances), and FIG. 7 shows different railway vehicle profiles with only deceleration.

Three different railway vehicle profiles were considered:

- random railway vehicle speed profiles: the railway vehicle moves with different random speeds between allowable railway vehicle speed ranges (this case relates to most track circuits);
- simultaneous railway vehicle deceleration and acceleration profiles: the railway vehicle moves with deceleration and acceleration at the same physical locations (such as those associated with temporary speed restrictions or changes in track curvature/grade); and
- continuous railway vehicle deceleration/acceleration profiles: the railway vehicle moves with deceleration (or acceleration) only speed profiles, where the railway vehicle only slows down (or speeds up).

Figure 8:
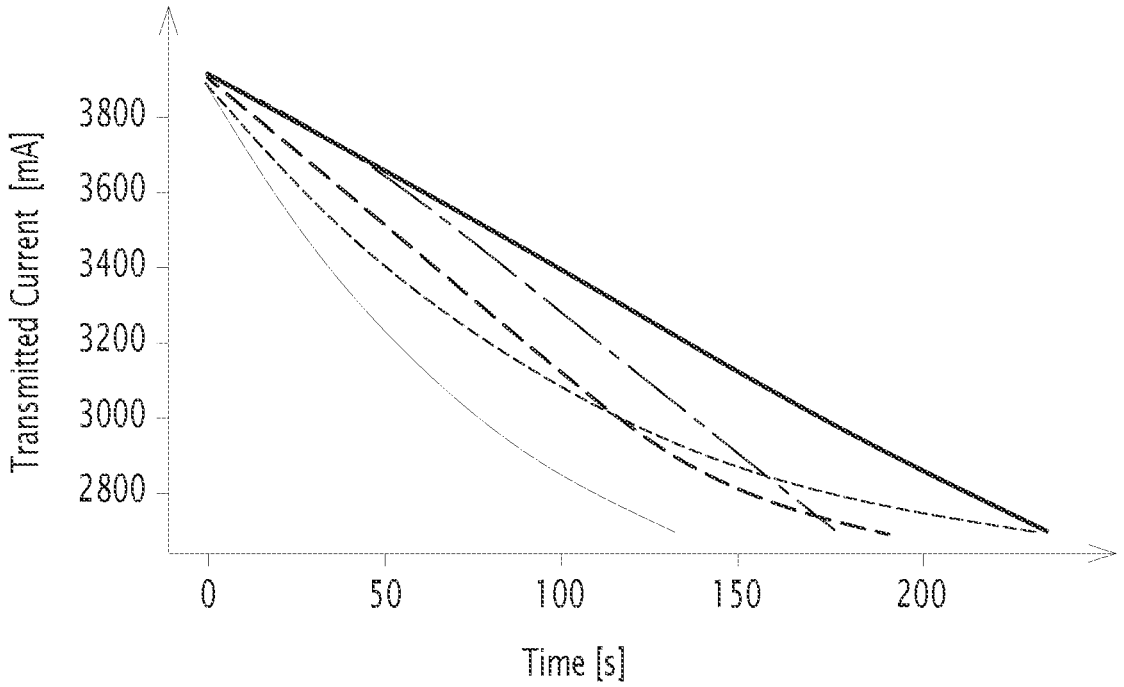
FIG. 8 is an illustration of simulated railway vehicle moves generated using the speed profiles from FIG. 5.
Figure 9:
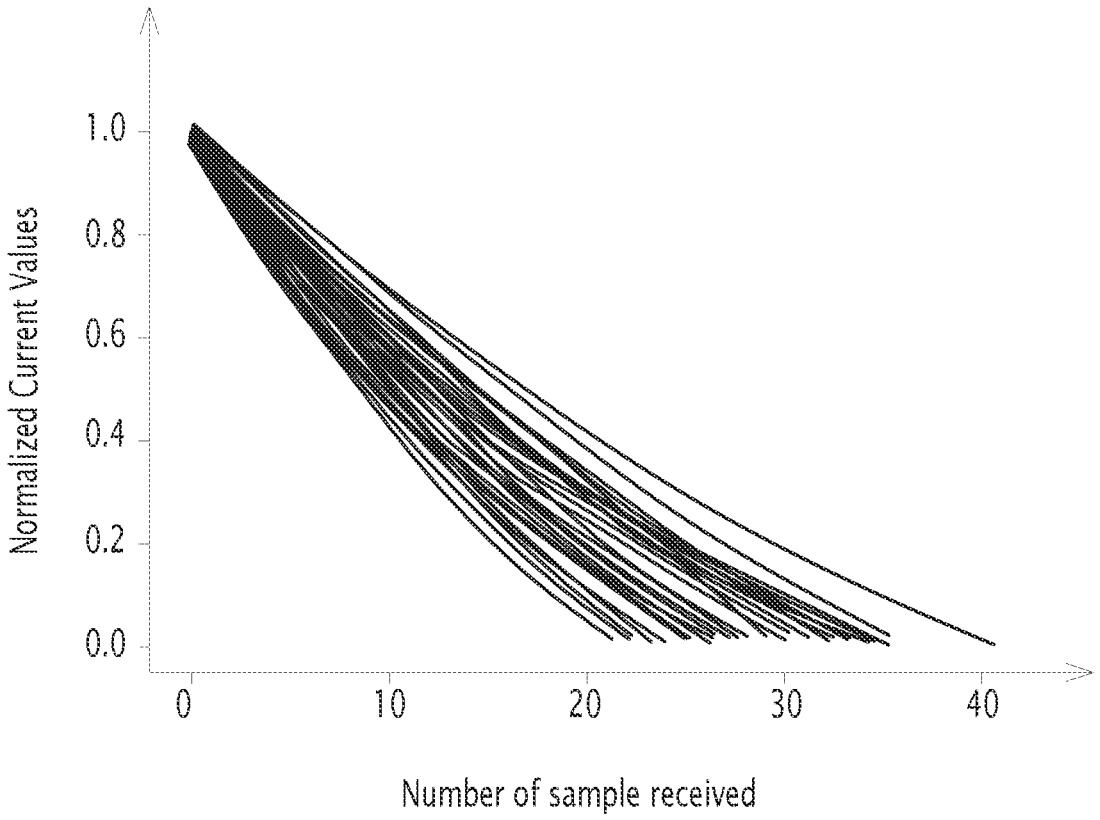
FIG. 9 is an illustration of simulated railway vehicle moves generated using the speed profiles from FIG. 6.
Figure 10:
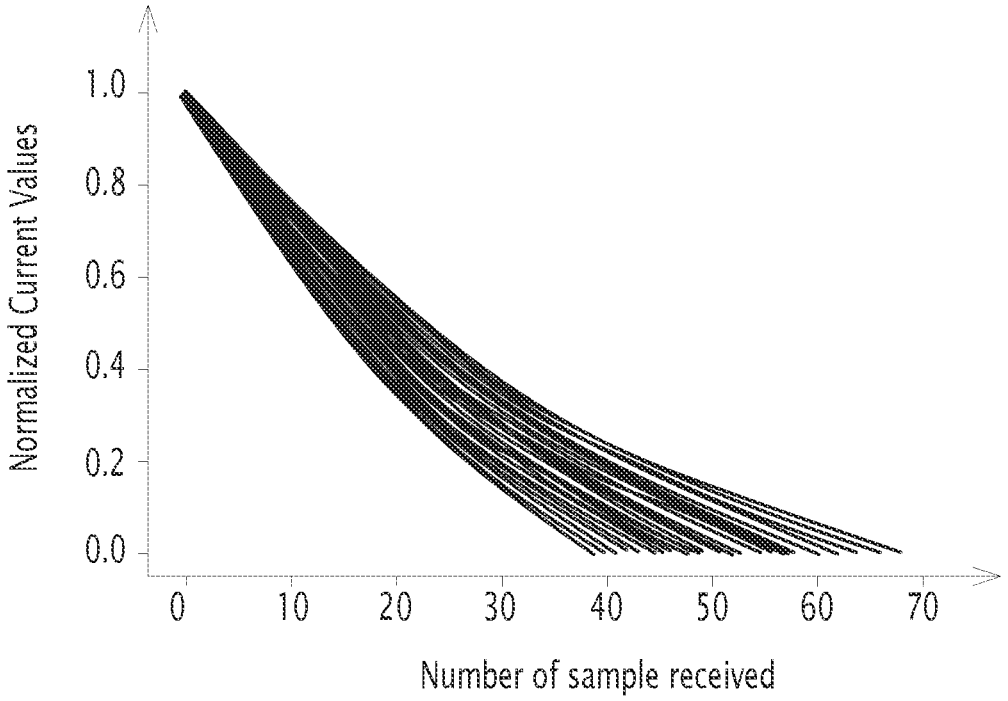
FIG. 10 is an illustration of simulated railway vehicle moves generated using the speed profiles from FIG. 7.

Using the known, true reference curve 60 and appropriate railway vehicle profiles, a set of fifty simulated railway vehicle moves was obtained, as illustrated in FIGS. 8, 9 and 10.

In particular, FIG. 8 is an illustration of simulated railway vehicle moves (transmitted current vs. time) generated using the speed profiles from FIG. 5. FIG. 9 shows simulated railway vehicle moves (transmitted current vs. time) generated using the speed profiles from FIG. 6. FIG. 10 shows simulated railway vehicle moves (transmitted current vs. time) generated using the speed profiles from FIG. 7.

The following figures show comparisons of calculated reference curves to the true reference curve 60, the calculated reference curves being generated using the method according to the conventional method and the present invention, respectively.

Figure 11:
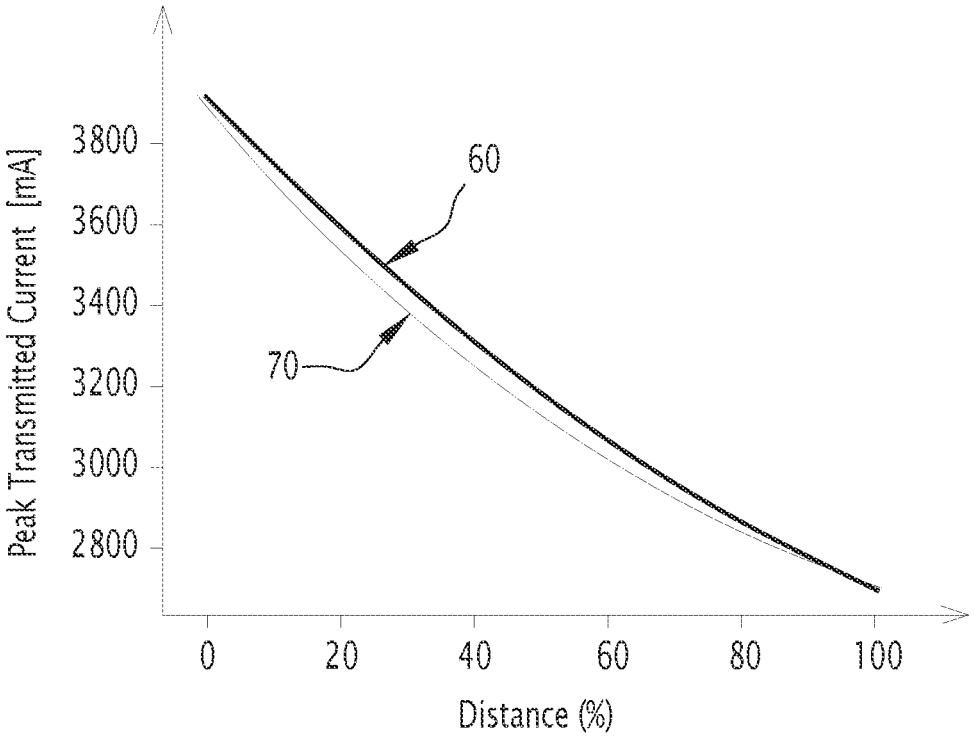
FIG. 11 is a comparison between the true reference curve and the calculated reference curve after running the conventional method, using the simulated railway vehicle moves of FIG. 8.
Figure 12:
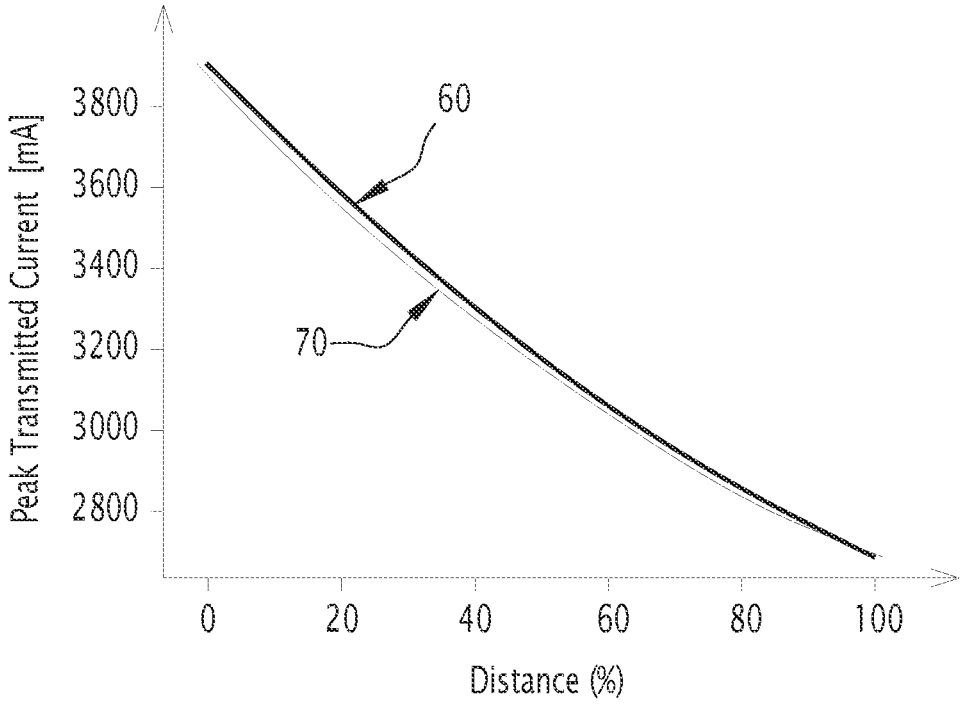
FIG. 12 is a comparison between the true reference curve and the calculated reference curve after running the method of the present invention, using the simulated railway vehicle moves of FIG. 8.

The results of comparing the methods are presented in FIGS. 11 and 12 for random railway vehicle speed profiles, and in FIGS. 13-16 for simultaneous railway vehicle deceleration/acceleration profiles.

In these figures, the calculated curve is indicated with the reference 70. To compare the results between the two methods, a Mean Squared Errors (MSE) calculation was performed to quantify the total fit/error between the true known reference curve 60 and the ones calculated with the different methods. In both cases, the method according to the present invention outperforms the conventional method, since the calculated reference curve 70 tends to be much closer to the true reference curve 60. Mean Squared Errors (MSE) show that the accuracy of the method according to the present invention is around three times better than the accuracy of the conventional method.

FIG. 11 is a comparison between the true reference curve 60 and the calculated reference curve 70 after running the conventional method using the simulated railway vehicle moves with the random speed profiles of FIG. 8. The MSE is 12.42%.

FIG. 12 is a comparison between the true reference curve 60 and the calculated reference curve 70 after running the method of the present invention using the simulated railway vehicle moves with the random speed profiles of FIG. 8. The MSE is 3.37% (almost three times smaller than in the conventional method).

Figure 13:
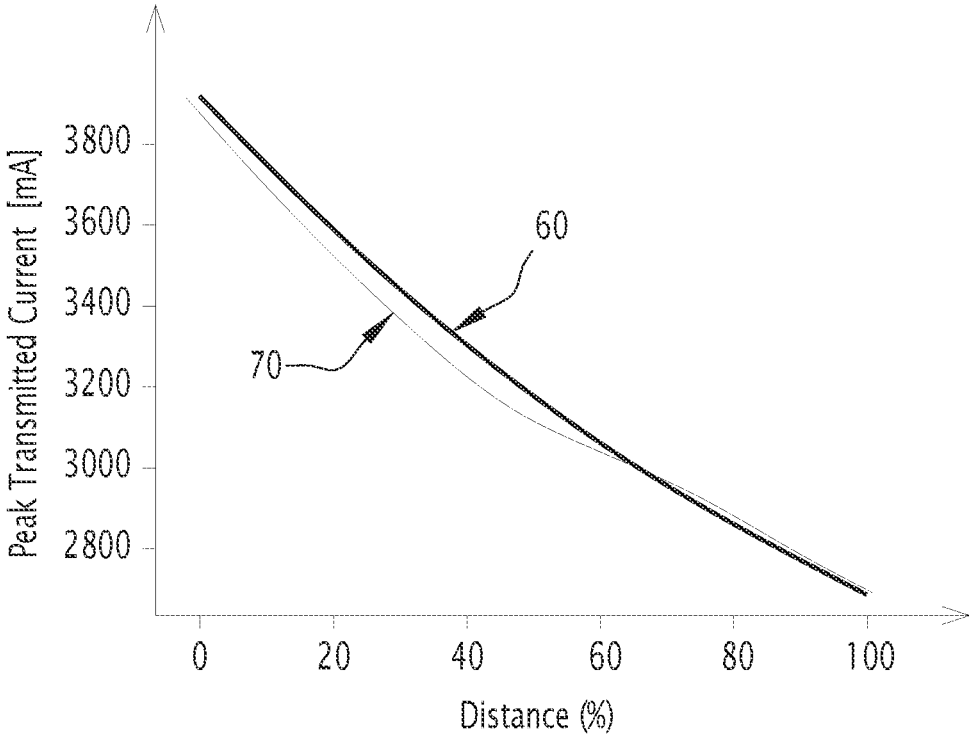
FIG. 13 is a comparison between the true reference curve and the calculated reference curve after running the conventional method, using the simulated railway vehicle moves of FIG. 9.

FIG. 13 is a comparison between the true reference curve 60 and the calculated reference curve 70 after running the conventional method using the simulated railway vehicle moves with simultaneous deceleration and acceleration profiles of FIG. 9. The MSE is 13.32%.

Figure 14:
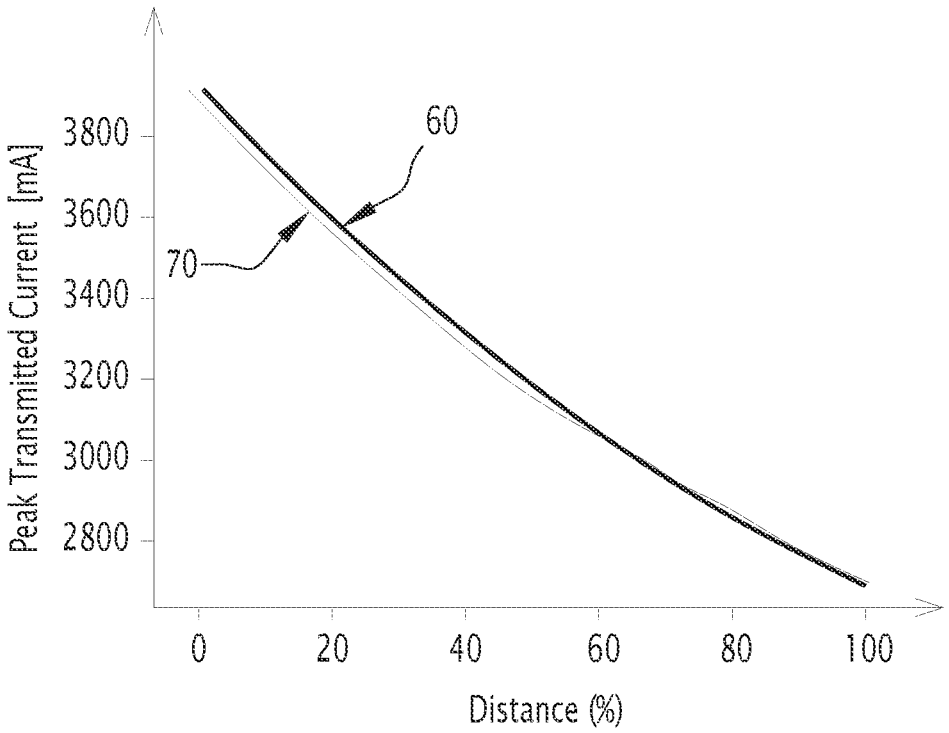
FIG. 14 is a comparison between the true reference curve and the calculated reference curve after running the method of the present invention, using the simulated railway vehicle moves profiles of FIG. 9.

FIG. 14 is a comparison between the true reference curve 60 and the calculated reference curve 70 after running the method of the present invention using the simulated railway vehicle moves with the simultaneous deceleration and acceleration profiles of FIG. 9. The MSE is 3.08% (almost four times smaller than in the conventional method).

Figure 15:
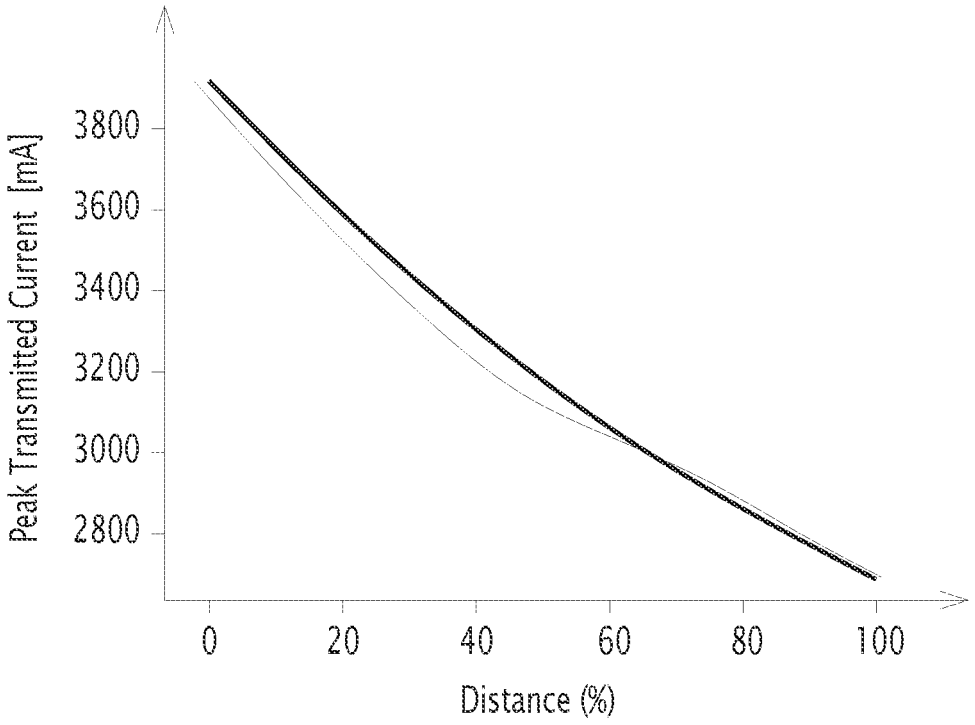
FIG. 15 is a comparison between the true reference curve and the calculated reference curve after running the conventional method, using simulated train moves of FIG. 10.

FIG. 15 is a comparison between the true reference curve 60 and the calculated reference curve 70 after running the conventional method using simulated train moves with the continuous deceleration profiles of FIG. 10. The MSE is 27.27%.

Figure 16:
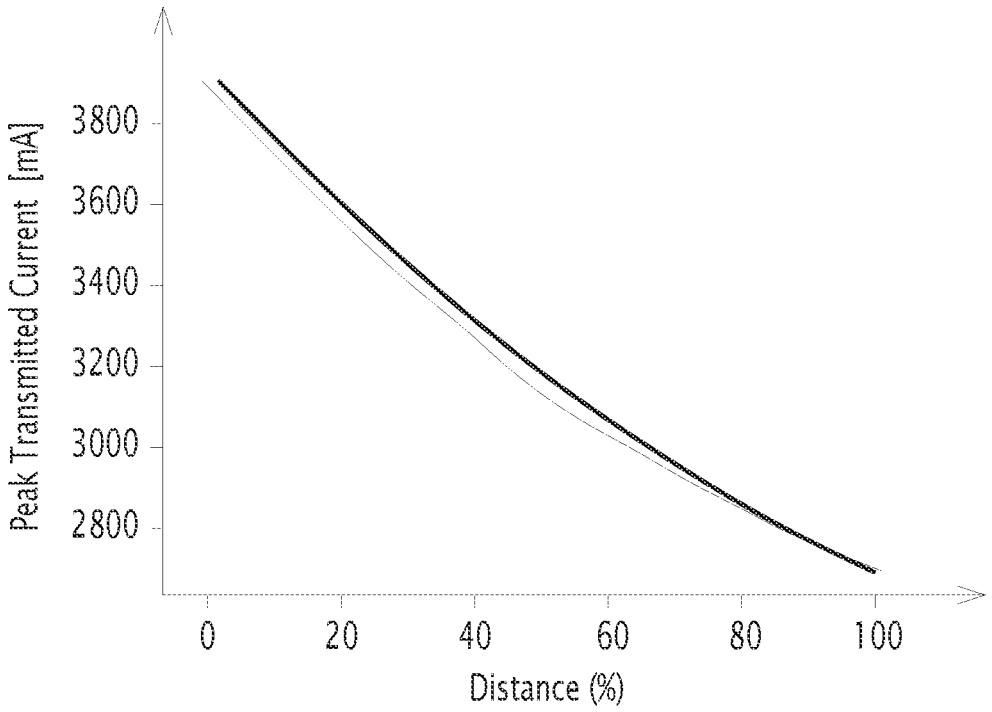
FIG. 16 is a comparison between the true reference curve and the calculated reference curve after running the method of the present invention, using the simulated railway vehicle moves of FIG. 10.

FIG. 16 is a comparison between the true reference curve 60 and the calculated reference curve 70 after running the method of the present invention using the simulated railway vehicle moves with the continuous deceleration profiles of FIG. 10. The MSE is 7.88% (almost three times smaller than in the conventional method).

The conventional method and the method according to the present invention were also compared using fifty real railway vehicle moves collected from a field test site. Each site was carefully surveyed and the track circuit transmitted current was measured at known locations by simulating a railway vehicle with a hardwire shunt.

Figure 17:
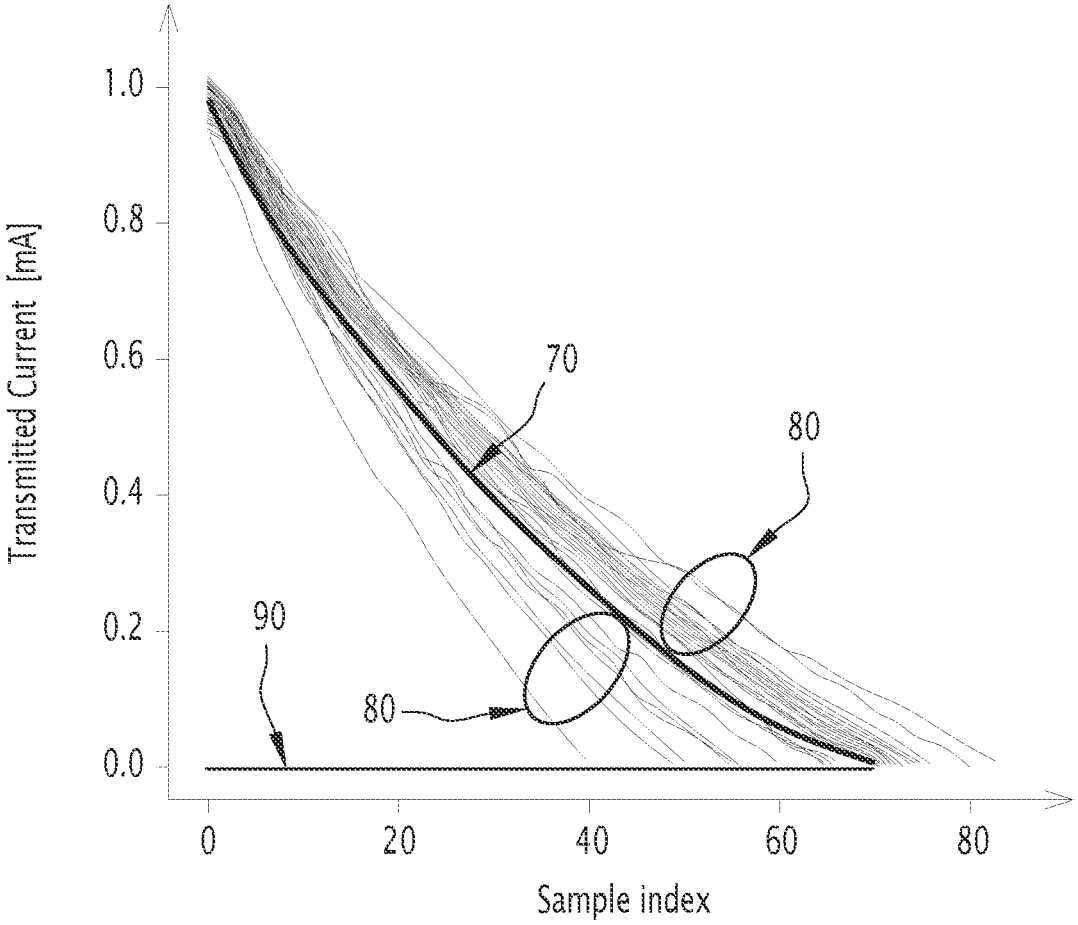
FIG. 17 is an illustration of a reference curved calculated with the conventional method based on fifty normalized railway vehicle moves.
Figure 18:
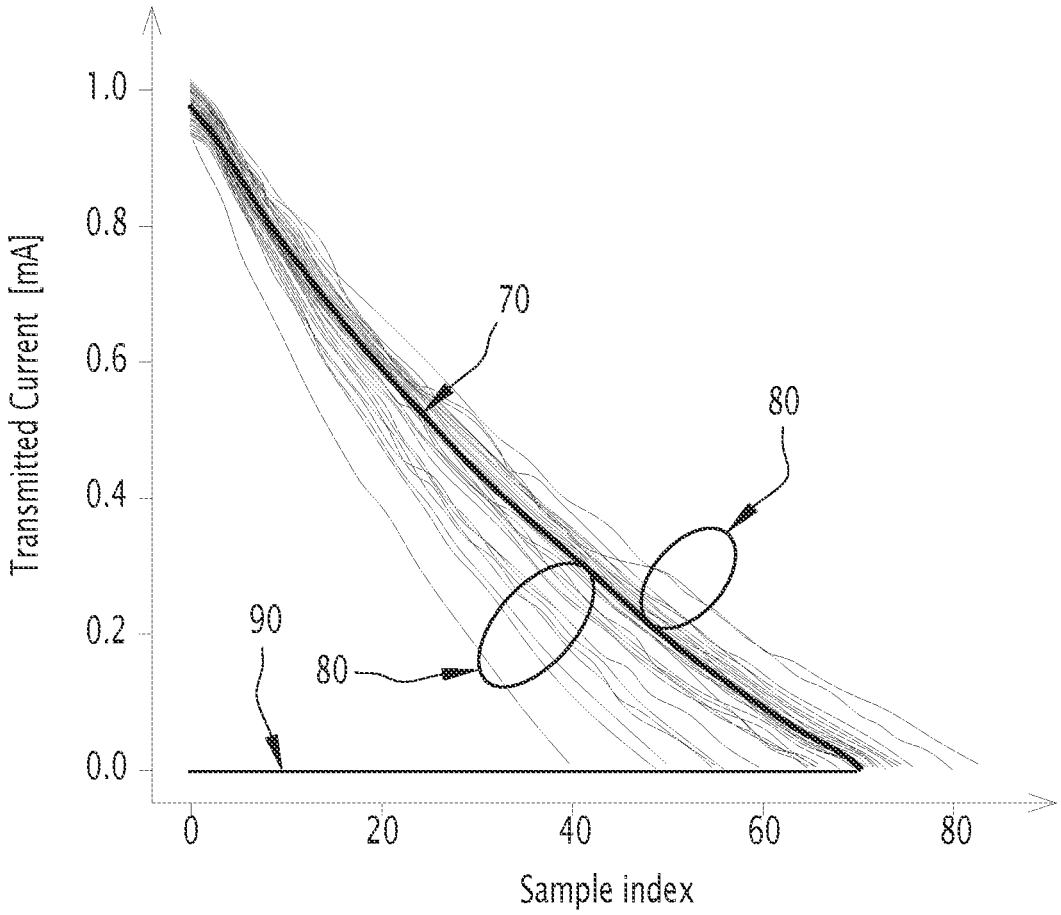
FIG. 18 is an illustration of a reference curved calculated with the method according to the present invention based on fifty normalized railway vehicle moves.

Firstly, the data has been pre-processed, using the above-disclosed global min-max normalization method. In FIGS. 17 and 18 the conventional method and the method according to the present invention, respectively, have been used to create a reference curve 70 based on fifty normalized railway vehicle moves (curves 80). The reference curve 70 is initialized as the sequence of all zeros (line 90).

Figure 19:
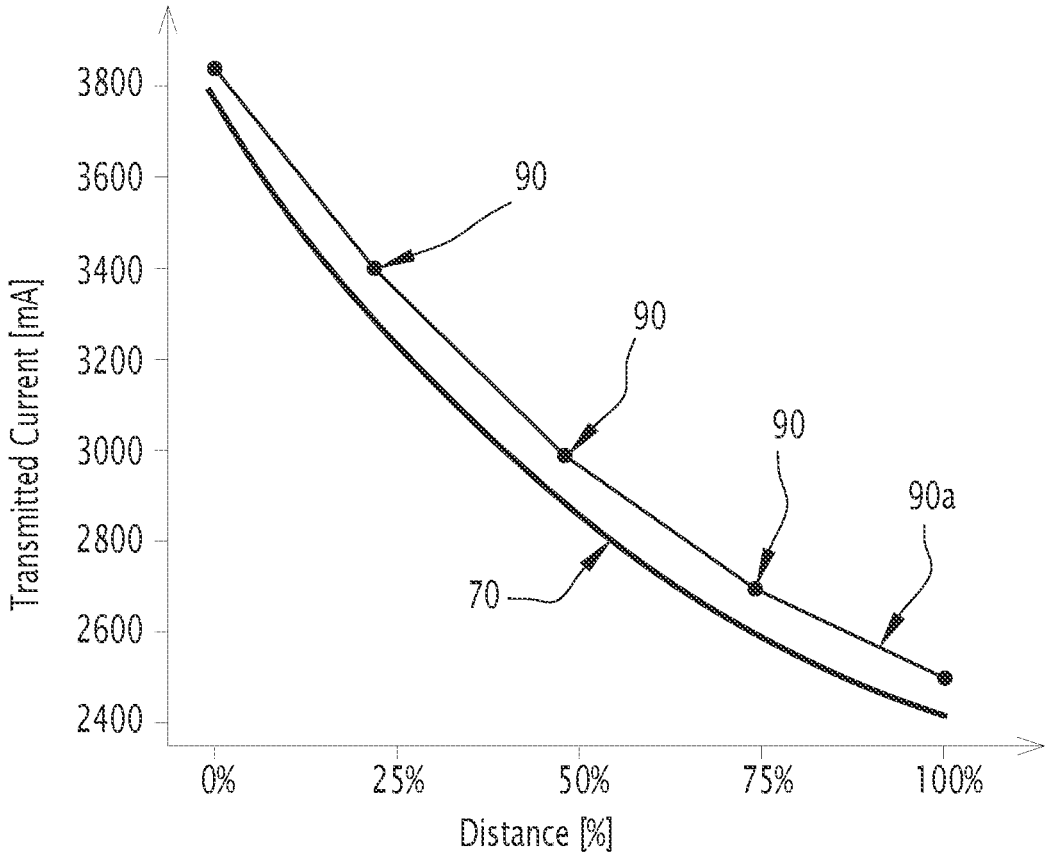
FIG. 19 is an illustration of the reference curve of FIG. 17 compared to surveyed shunting points.
Figure 20:
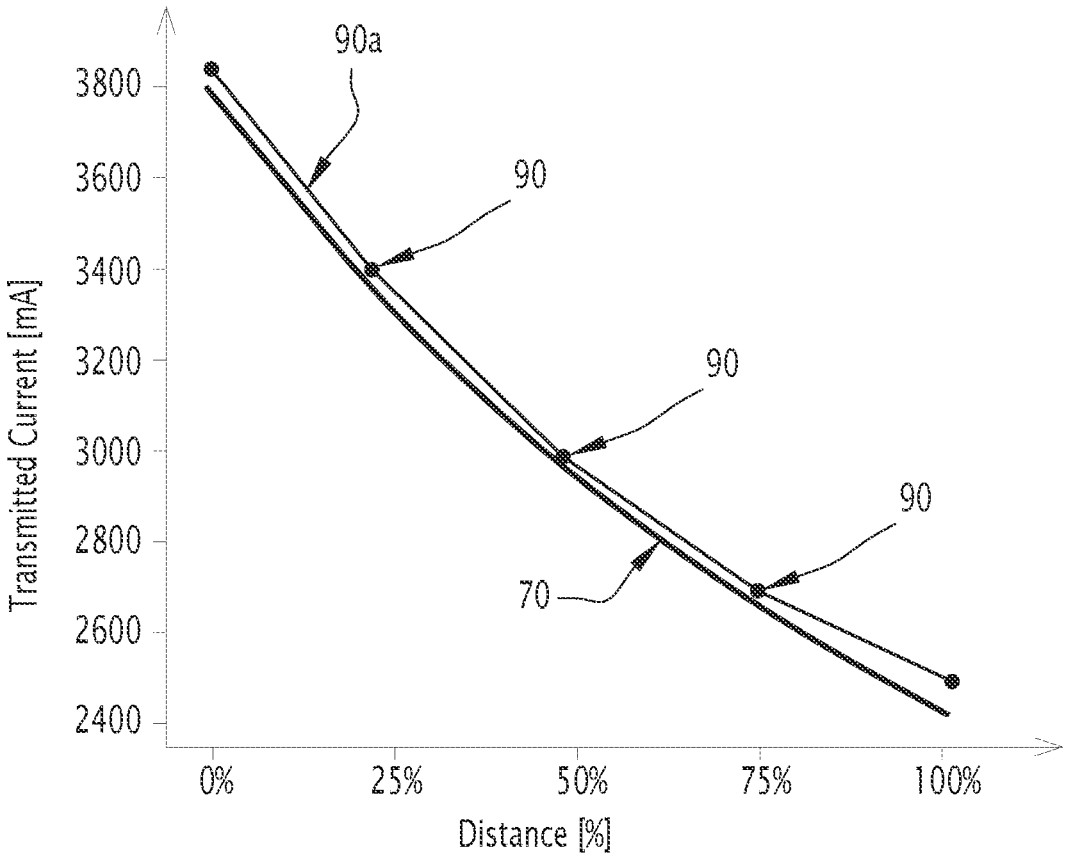
FIG. 20 is an illustration of the reference curve of FIG. 18 compared to surveyed shunting points.

The calculated reference curves 70 of FIGS. 17 and 18, calculated using both methods, are shown in FIGS. 19 and 20, respectively, and are compared to surveyed shunting points 90 representing "true" railway vehicle locations for given transmitted current values.

The same initial curve (all zeros) has been used. It is worth noticing that the Mean Squared Error (MSE), calculated as a measure of difference between the reference curve 90 and a shunting data curve 90*a*, representing a fitting curve of the shunting points 90, is significantly smaller in the case of the method according to the present invention compared to the conventional method (smaller MSE value indicates very small difference between the curves, thus indicating a good alignment).

From FIGS. 17-20, it is observed that the conventional method pulls the reference curve 70 towards the slower moving railway vehicles that have different shapes from the other railway vehicles moves, whereas the method according to the present invention, due to its weighted approach, assigns less weight to these outliers.

Figure 21:
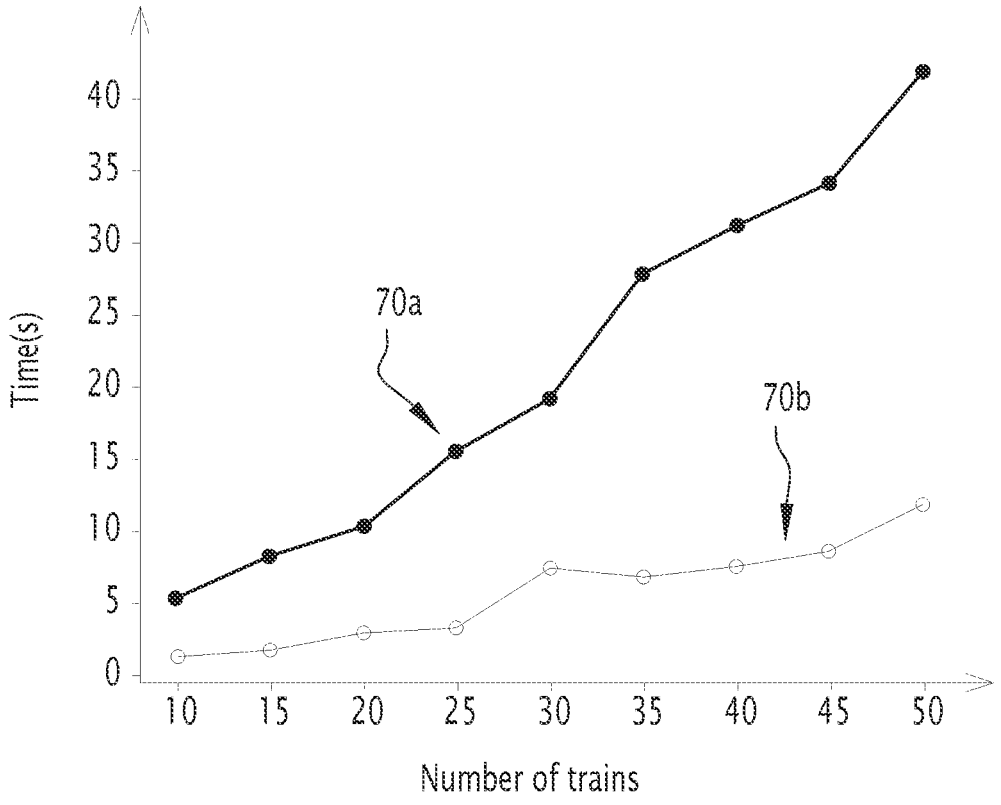
FIG. 21 is a comparison of the computational run time versus the number of train moves used to generate the reference curves 70*b*, 70*a* respectively, with the method of the present invention and with the conventional method.

Finally, performance improvements of the proposed method over the conventional have been demonstrated. For different number of railway vehicles moves (from 10 up to 50, in increments of 5) the time needed to generate the reference curves 70 was measured using both methods. Run-time results are shown in FIG. 21, which presents the computational run time vs. the number of train moves used to generate the reference curves 70*a*, 70*b*, respectively, with the method of the present invention and with the conventional method. From FIG. 21, it is observed that the execution times of the method according to the present invention are much smaller than in the conventional one, and that with the increase of the railway vehicles moves, the run-times of the method according to the present invention increase much less compared with the conventional method.

Clearly, the principle of the invention remaining the same, the embodiments and the details of production can be varied considerably from what has been described and illustrated purely by way of non-limiting example, without departing from the scope of protection of the present invention as defined by the attached claims.

What is claimed is:

1. Method for determining the relationship between a track-circuit current signal and a railway vehicle location, comprising:

sending, by a track circuit, a current signal across a railway track block;

measuring the current signal for different railway vehicles running successively on the railway track block, thus obtaining a plurality of railway vehicle move samples;

normalizing the railway vehicle move samples;

initializing a reference curve; and applying a Weighted Dynamic Time Warping Barycenter Averaging (WDBA) algorithm to calculate a final reference curve representing the relationship between the measured track-circuit current signal and the railway vehicle location on the railway track block.

2. The method of claim 1, wherein said initializing comprises determining a reference curve corresponding to a sequence of numbers between 0 and 1.

3. The method of claim 2, wherein the sequence of numbers between 0 and 1 comprises random numbers.

4. The method of claim 2, wherein the sequence of numbers between 0 and 1 comprises values of a deterministic curve.

5. The method according to claim 1, wherein said normalizing comprises performing a global minimum-maximum normalization using global minimum and maximum values of the railway vehicle moves according to the following equations:

$$I_{min}=\min\{\min(I_1),\min(I_2),\ldots,\min(I_T)\} \text{ and}$$

$$I_{max}=\max\{\max(I_1),\max(I_2),\ldots,\max(I_T)\}$$

respectively, where min and max represent minimum and maximum operations, and $I_T$ is the railway vehicle move that contains Pt transmitted current values, $I_{t1}, I_{t2}, \ldots, I_{tPt}$ up to T total railway vehicle moves, wherein a global minimum-maximum normalization is calculated according to the following equation:

$$I_{tp}^{n}=\frac{I_{tp}-I_{min}}{I_{max}-I_{min}},$$

where $I^{n}_{tp}$ represents a normalized value of the p-th sample of t-th railway vehicle move.

6. The method according to claim 1, wherein said applying a WDBA algorithm comprises:

calculating, for each normalized railway vehicle move sample and with reference to the initialized reference curve, a Dynamic Time Warping score, so as to determine corresponding intermediate points; and performing, based on the intermediate points, a weighted average, to update the values of the initialized reference curve, thus obtaining the final reference curve.

7. The method according to claim 6, wherein the weighted average in said performing is obtained from a Gaussian kernel curve, which allows calculating weights based on the difference between sequence indices between the initialized reference curve and the railway vehicle move samples.

8. Controller for determining the relationship between a track-circuit transmitted current signal and a railway vehicle location on a railway track, the controller connected to a track circuit arranged to send a current signal across a railway track block on which different railway vehicles are running successively, the controller arranged to perform the method according to claim 1.

9. Track circuit comprising a controller according to claim 8.

* * * * *